US012534171B2

(12) United States Patent
Kawai

(10) Patent No.: US 12,534,171 B2
(45) Date of Patent: Jan. 27, 2026

(54) MARINE VESSEL PROPULSION APPARATUS

(71) Applicant: HONDA MOTOR CO., LTD., Tokyo (JP)

(72) Inventor: Norikazu Kawai, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 562 days.

(21) Appl. No.: 17/901,888

(22) Filed: Sep. 2, 2022

(65) Prior Publication Data

US 2024/0076024 A1 Mar. 7, 2024

(51) Int. Cl.

| | |
|---|---|
| ***B63H 20/34*** | (2006.01) |
| ***B63H 20/14*** | (2006.01) |
| ***B63H 20/28*** | (2006.01) |
| ***B63H 20/32*** | (2006.01) |

(52) U.S. Cl.

CPC ..... *B63H 20/34* (2013.01); *B63H 20/14* (2013.01); *B63H 20/28* (2013.01); *B63H 2020/323* (2013.01)

(58) Field of Classification Search

CPC ..... B63H 20/34; B63H 20/14; B63H 20/28; B63H 2020/323

See application file for complete search history.

(56) References Cited

U.S. PATENT DOCUMENTS

| | | | | |
|---|---|---|---|---|
| 1,824,739 A * | 9/1931 | Johnson | ..... | F01N 3/043 416/93 R |
| 3,650,310 A * | 3/1972 | Childress | ..... | F28D 1/022 165/44 |
| 2019/0271255 A1* | 9/2019 | Coller | ..... | B63H 20/28 |

FOREIGN PATENT DOCUMENTS

| | | |
|---|---|---|
| JP | 61-205597 | 9/1986 |

* cited by examiner

*Primary Examiner* — Stephen P Avila

(74) *Attorney, Agent, or Firm* — Amin, Turocy & Watson, LLP

(57) ABSTRACT

A propulsion apparatus includes a screw, a unit case, an anti-cavitation plate, a heat generation portion, and a cooling liquid passage. The screw is submerged in outside water and generates a propulsion force. The unit case accommodates at least a power transmission mechanism which transmits power from a drive source to the screw. The anti-cavitation plate is arranged on the unit case at a higher position than the screw, and at least part of the anti-cavitation plate is submerged in outside water. The heat generation portion is arranged at an inside or an outside of the unit case. The cooling liquid passage causes a cooling liquid to flow to the heat generation portion. Part of the cooling liquid passage is arranged within the anti-cavitation plate.

15 Claims, 11 Drawing Sheets

MARINE VESSEL PROPULSION APPARATUS

BACKGROUND OF THE INVENTION

Field of the Invention

The present invention relates to a marine vessel propulsion apparatus.

Background Art

An outboard engine and an inboard-outdrive engine are known as propulsion apparatuses of a marine vessel.

The outboard engine is attached to a stern plate (transom board) of a hull, and a drive source such as an engine or a motor together with a power transmission mechanism are provided on an outboard engine case (unit case). A screw that is rotated by power of the drive source is provided in a lower region of the outboard engine case. The screw is submerged in outside water such as seawater or fresh water and generates a propulsion force by the rotation by the drive source.

In the inboard-outdrive engine, a drive source such as an engine or a motor is provided on a hull side, and a unit case is attached to a rear portion of the hull. A screw that rotates in the outside water is arranged in a lower region of the unit case. The screw is driven by the drive source on the hull side through a power transmission mechanism.

As a propulsion apparatus of this type of marine vessel, such an apparatus has been developed that cools a heat generation portion such as the drive source or a control device by a cooling liquid (for example, refer to Patent Document 1 (Japanese Unexamined Patent Application, First Publication No. S61-205597)).

The propulsion apparatus disclosed in Patent Document 1 includes a cooling liquid passage in which a cooling liquid flows to an engine, which is a heat generation portion. The cooling liquid passage is connected to a cooling liquid storage portion that is formed in the lower region (speed reducer case portion) of the unit case.

In this propulsion apparatus, since the lower region of the unit case is submerged in the outside water at the time of navigation of the marine vessel, the cooling liquid in the cooling liquid storage portion can be cooled by the outside water through a circumferential wall of the lower region.

SUMMARY OF THE INVENTION

The propulsion apparatus of a marine vessel disclosed in Patent Document 1 has a structure in which the cooling liquid storage portion is arranged in the lower region of the unit case that is submerged in the outside water, and the cooling liquid in the cooling liquid storage portion is cooled by the outside water through the circumferential wall of the lower region. However, it is difficult to make the circumferential wall of the unit case thinner than a certain thickness due to functional reasons. Therefore, it is desired to further improve the cooling efficiency of the cooling liquid.

Further, since the propulsion apparatus of a marine vessel disclosed in Patent Document 1 cools the entire amount of cooling liquid in the storage portion by the outside water, it is difficult to quickly cool the cooling liquid that flows to the heat generation portion.

Accordingly, the present invention intends to provide a marine vessel propulsion apparatus capable of efficiently cooling a cooling liquid that flows to a heat generation portion by outside water.

A marine vessel propulsion apparatus according to an aspect of the present invention includes: a screw (for example, a screw 10 of an embodiment) that is submerged in outside water and generates a propulsion force; a unit case (for example, an outboard motor case 12 of the embodiment) that accommodates at least a power transmission mechanism (for example, a power transmission mechanism 13 of the embodiment) which transmits power from a drive source (for example, an electric motor 11 of the embodiment) to the screw; an anti-cavitation plate (for example, an anti-cavitation plate 45 of the embodiment) that is arranged on the unit case at a higher position than the screw and is at least partially submerged in outside water; a heat generation portion (for example, a heat generation portion 11*b* of the embodiment) that is arranged at an inside or an outside of the unit case; and a cooling liquid passage (for example, a cooling liquid passage 24 of the embodiment) that causes a cooling liquid to flow to the heat generation portion, wherein part of the cooling liquid passage is arranged within the anti-cavitation plate.

In the configuration described above, when the marine vessel is propelled by the rotation of the screw, the anti-cavitation plate prevents cavitation associated with the rotation of the screw from occurring. At this time, at least part of the anti-cavitation plate is submerged in the outside water at a higher position than the screw. Therefore, the cooling liquid in the cooling liquid passage that is arranged within the anti-cavitation plate is efficiently cooled by a fast water flow of the outside water that flows at upper and lower sides of the anti-cavitation plate. The cooling liquid cooled in this way flows into the heat generation portion and cools the heat generation portion.

Part of the cooling liquid passage that is arranged within the anti-cavitation plate may include a flow passage (for example, an inflow flow passage 46*i* and an outflow flow passage 46*o* of the embodiment,) through which the cooling liquid flows along a propulsion direction.

In this case, the cooling liquid is efficiently cooled by the water flow of the outside water that flows at upper and lower sides of the anti-cavitation plate while the cooling liquid flows through the flow passage along the propulsion direction in the anti-cavitation plate.

A plurality of flow passages may be provided in an extension direction of the anti-cavitation plate, and an irregular portion (for example, an irregular portion 49 of the embodiment) along each of the flow passages may be provided on an outer surface of the anti-cavitation plate.

In this case, since the irregular portion along each flow passage is provided on the outer surface of the anti-cavitation plate, the outer surface of the anti-cavitation plate comes into contact with the water flow of the outside water over a large surface area. Therefore, when the present configuration is employed, the cooling liquid that flows through the cooling liquid passage in the anti-cavitation plate can be efficiently cooled while preventing an operation resistance at the outer surface of the anti-cavitation plate.

The flow passage may have an upper flow passage (for example, an upper flow passage 52*u*, 146*u* of the embodiment) that flows to one side along the propulsion direction and a lower flow passage (for example, a lower flow passage 52*l*, 146*l* of the embodiment) that flows to another side along the propulsion direction at an upper side of the upper flow passage.

In this case, the cooling liquid in the cooling liquid passage can be efficiently cooled by outside water at a lower surface and an upper surface of the anti-cavitation plate at the time of navigation of the marine vessel.

The cooling liquid that has cooled the heat generation portion may flow in the lower flow passage, and the cooling liquid that has passed through the lower flow passage may flow to the upper flow passage.

In this case, the cooling liquid which has absorbed the heat of the heat generation portion and has a large amount of heat is efficiently cooled at the lower surface of the anti-cavitation plate that is reliably submerged in the outside water. Accordingly, when the present configuration is employed, stable cooling of the cooling liquid by the outside water becomes possible.

A rearward extension portion (for example, a rearward extension portion 12Lb of the embodiment) that protrudes further rearward in a propulsion direction than a rear end portion of the anti-cavitation plate may be provided on the unit case.

In this case, since the rearward extension portion of the unit case protrudes further rearward than the rear end portion of the anti-cavitation plate, even if a rear portion of the propulsion apparatus comes into contact with a pier or the like, the rear portion of the rearward extension portion comes into contact with the pier or the like before the anti-cavitation plate. Therefore, when the present configuration is employed, it is possible to prevent the cooling liquid passage in the anti-cavitation plate from being damaged.

The anti-cavitation plate may be constituted of a separate component that is separate from the unit case, a plate extension portion (for example, a plate extension portion 55 of the embodiment) may be provided on the unit case so as to continue forward from a front portion in a propulsion direction of the anti-cavitation plate, and at least one of an upper surface and a lower surface of the plate extension portion may be flush with a corresponding upper surface and a corresponding lower surface of the anti-cavitation plate.

In this case, since the anti-cavitation plate is constituted of a separate component that is separate from the unit case, even when a complex cooling liquid passage is formed within the anti-cavitation plate, the anti-cavitation plate can be easily shaped by a process that is separate from that for the unit case.

Although the anti-cavitation plate is a separate component that is separate from the unit case, at least one of the upper surface and the lower surface of the anti-cavitation plate is flush with the corresponding upper surface and the corresponding lower surface of the plate extension portion on the unit case side. Therefore, when the present configuration is employed, it is possible to reduce water flow resistance at the time of navigation of the marine vessel, and it is possible to increase a flow speed of outside water that flows at a surface of the anti-cavitation plate.

A recess portion (for example, a recess portion 58 of the embodiment) may be provided on a confronting surface (for example, a confronting surface 57 of the embodiment) with the unit case at a front portion of the anti-cavitation plate.

In this case, when the confronting surface of the front portion of the anti-cavitation plate is abutted against the unit case, a heat insulation space by the recess portion is formed between the unit case and the front portion of the anti-cavitation plate. Accordingly, when the present configuration is employed, the heat of the cooling liquid that has absorbed the heat of the heat generation portion is not easily transmitted from the front portion of the anti-cavitation plate to a component such as a seal member on the unit case side.

The cooling liquid passage may include a plurality of lines in each of which a different cooling liquid flows, and part of each of the plurality of lines of the cooling liquid passage may be arranged within the anti-cavitation plate.

In this case, the different cooling liquids that flow in the plurality of lines of the cooling liquid passage can be efficiently cooled by using a common anti-cavitation plate.

Effects of the Invention

In the marine vessel propulsion apparatus according to an aspect of the present invention, since part of the cooling liquid passage is arranged within the anti-cavitation plate, the cooling liquid can be efficiently cooled by a fast water flow of the outside water that flows at upper and lower sides of the anti-cavitation plate at the time of navigation of the marine vessel. Accordingly, when the marine vessel propulsion apparatus according to the aspect of the present invention is employed, the cooling liquid that flows to the heat generation portion can be efficiently cooled by the outside water.

EMBODIMENTS

Figure 1:
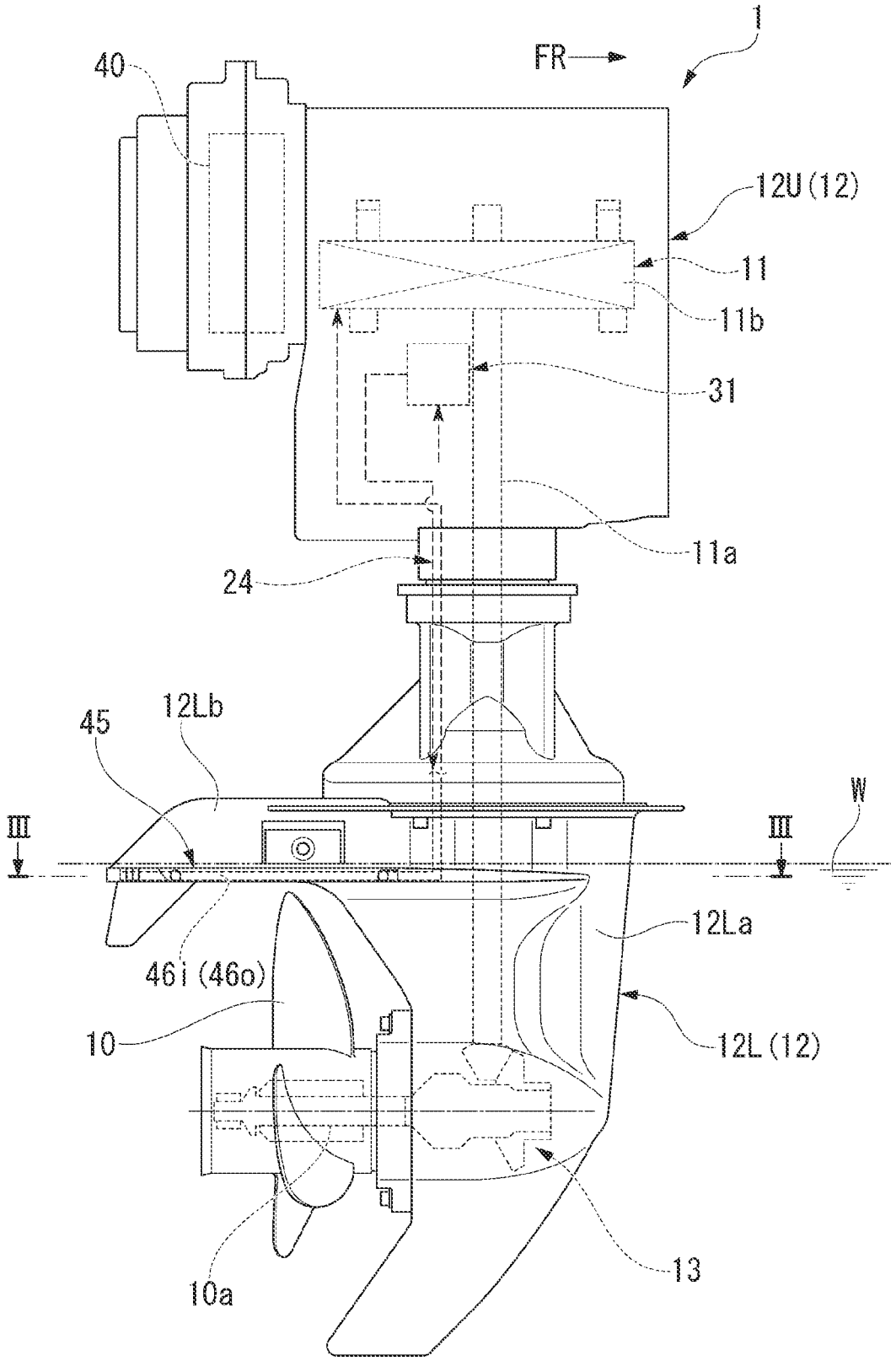
FIG. 1 is a side view of an electric outboard motor (propulsion apparatus) of a first embodiment.

Hereinafter, embodiments of the present invention will be described with reference to the drawings.

In an appropriate position of the drawings, an arrow FR that indicates a forward side of a propulsion direction of a propulsion apparatus is shown. In the embodiments described below, common portions are denoted by the same reference numerals, and redundant descriptions are partially omitted.

First Embodiment

A propulsion apparatus of a marine vessel of the present embodiment is an electric outboard motor 1 driven by an electric motor 11.

Figure 2:
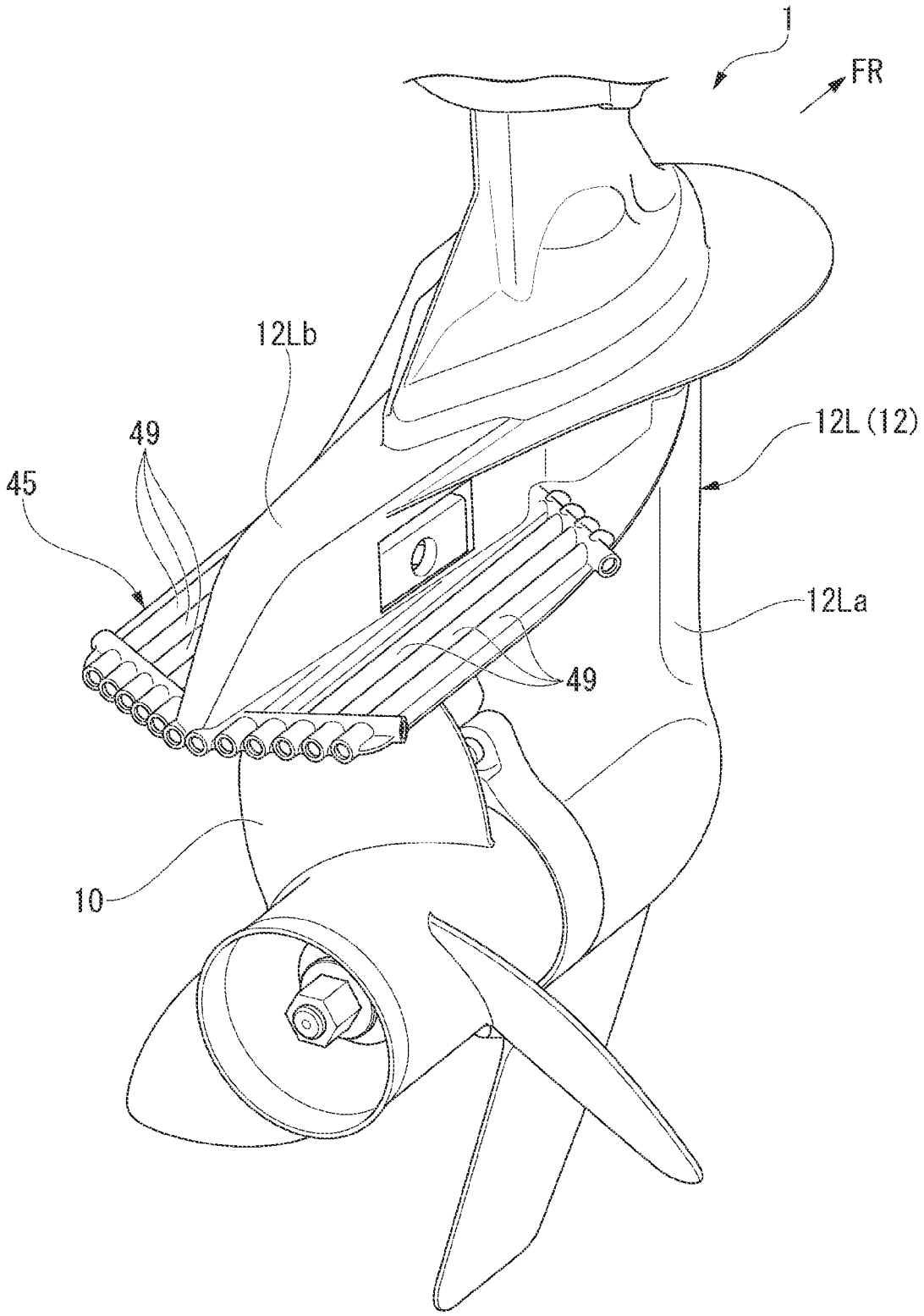
FIG. 2 is a perspective view of the electric outboard motor (propulsion apparatus) of the first embodiment.

FIG. 1 is a side view of the electric outboard motor 1 of the present embodiment, and FIG. 2 is a perspective view of the electric outboard motor 1 when seen from a rearward side.

The electric outboard motor 1 can be attached to a stern plate (transom board) at a rear portion of a hull (not shown). The electric outboard motor 1 includes: a screw 10 that is submerged in water (hereinafter, referred to as "outside water w") of a sea, a river, a lake, or the like and generates a propulsion force; the electric motor 11 (drive source) that rotates and drives the screw 10; and an outboard motor case 12 that accommodates a drive-related component including the electric motor 11 therein. The outboard motor case 12 is supported by a skeleton member (not shown). The skeleton member is supported rotatably in an upward-downward direction by the rear portion of the hull around a tilt shaft (not shown).

In the present embodiment, the outboard motor case 12 constitutes a unit case in the propulsion apparatus.

When the electric outboard motor 1 is in an attitude in which the screw 10 is submerged in the outside water w, a side that faces vertically upward is referred to as "upward", and a side that faces vertically downward is referred to as "downward". Further, a direction in which the electric outboard motor 1 proceeds in response to the propulsion force of the screw 10 is referred to as "forward", and a direction opposite to the direction in which the electric outboard motor 1 proceeds is referred to as "rearward".

The outboard motor case 12 includes a motor case portion 12U that accommodates the electric motor 11 and a gear case portion 12L that accommodates a power transmission mechanism 13. The power transmission mechanism 13 is a speed reduction mechanism including a plurality of gears, reduces the speed of the rotation of an output shaft 11*a* of the electric motor 11 at a predetermined speed reduction ratio, and transmits the rotation to the screw 10. The motor case portion 12U is attached to the rear portion of the hull, and the gear case portion 12L is rotatably connected to a lower section of the motor case portion 12U. The gear case portion 12L is rotatable around a rotation center axis line that is coaxial with the output shaft 11*a* of the electric motor 11.

Further, the gear case portion 12L is rotated and operated in a predetermined angle range by a motor for rotation (not shown) that is arranged in the motor case portion 12U. The screw 10 supported by the gear case portion 12L rotates together with the gear case portion 12L. The electric outboard motor 1 can change the propulsion direction by changing the direction of the screw 10 by this motor.

The screw 10 is supported rotatably integrally with a screw shaft 10*a* that penetrates in a forward-rearward direction through a rear wall of the gear case portion 12L. The screw shaft 10*a* is connected to the power transmission mechanism 13 at the inside of the gear case portion 12L. The screw 10 is arranged on a rear lower end of the gear case portion 12L. The screw 10 generates a propulsion force by receiving a rotation power of the electric motor 11 and rotating in the outside water w.

Part of the gear case portion 12L which constitutes a lower region of the outboard motor case 12 is submerged in the outside water w together with the screw 10 at the time of navigation of the marine vessel.

A control unit 40 that includes a drive circuit of the electric motor 11 is arranged on a rear surface on a rearward side of the motor case portion 12U. A battery (not shown) which is an electric power source such as the electric motor 11 is arranged within the motor case portion 12U or the hull.

Further, a cooling liquid storage portion (not shown) that stores a cooling liquid and a pump device 31 for suctioning the cooling liquid in the cooling liquid storage portion and causing the cooling liquid to flow to the cooling liquid passage 24 are arranged within the motor case portion 12U. A cooling liquid that contains a lubrication oil component is used for the cooling liquid stored in the cooling liquid storage portion. The cooling liquid is supplied to a mechanical component in the motor case portion 12U and thereby can lubricate the mechanical component. The pump device 31 is driven, for example, by the output shaft 11*a* of the electric motor 11. Various types of pump devices 31 can be employed such as a trochoid type, a centrifugal type, or a gear type as long as the pump device 31 can send the cooling liquid suctioned from the cooling liquid storage portion to the cooling liquid passage 24.

The cooling liquid passage 24 sends the cooling liquid suctioned from the cooling liquid storage portion by the pump device 31 to the gear case portion 12L side, and the cooling liquid is cooled by heat exchange with the outside water w at the gear case portion 12L side. Then, the cooling liquid passage 24 causes the cooling liquid that is cooled at the gear case portion 12L side to return to the motor case portion 12U side again, and the cooling liquid is discharged to a heat generation portion 11*b* of the electric motor 11. Thereby, the heat generation portion 11*b* is cooled by the cooling liquid. At this time, the cooling liquid discharged to the heat generation portion 11*b* drops downward and is stored in the cooling liquid storage portion. The cooling liquid stored in the cooling liquid storage portion is sent to the cooling liquid passage 24 by the pump device 31 again.

The heat generation portion 11*b* of the electric motor 11 is, for example, a motor case that covers the outside of a stator and a coil, a drive circuit of a motor, and the like. However, depending on the structure of the electric motor 11, the heat generation portion 11*b* may be a rotor or the coil itself.

The gear case portion 12L includes: a case main body 12La that accommodates the power transmission mechanism 13 therein and has a hollow shape; a rearward extension portion 12Lb that extends rearward in a propulsion direction from the case main body 12La; and an anti-cavitation plate 45 that is provided to continue to an outer circumference portion of the case main body 12La and a lower surface of the rearward extension portion 12Lb. The anti-cavitation plate 45 is formed in a substantially horizontal plate shape that is wider than the case main body 12La and the rearward extension portion 12Lb. The anti-cavitation plate 45 extends at an approximately equal width from an outer portion of the case main body 12La to a position approximately equal to a rear end section of the rearward extension portion 12Lb.

The anti-cavitation plate 45 may have a shape in which the entire anti-cavitation plate 45 extends substantially horizontally but may have an approximately V shape in a rear view as shown in FIG. 2. Further, the shape of the anti-cavitation plate 45 is not limited thereto.

The anti-cavitation plate 45 is arranged so as to cover an upper side of the screw 10. The screw 10 is arranged to protrude rearward from a rear wall on a lower side of the case main body 12La. At least a lower side of the anti-cavitation plate 45 is submerged in the outside water w at the time of navigation of the marine vessel. The anti-cavitation plate 45 prevents air entrainment (occurrence of cavitation) by the screw when the screw 10 rotates in the outside water w.

Figure 3:
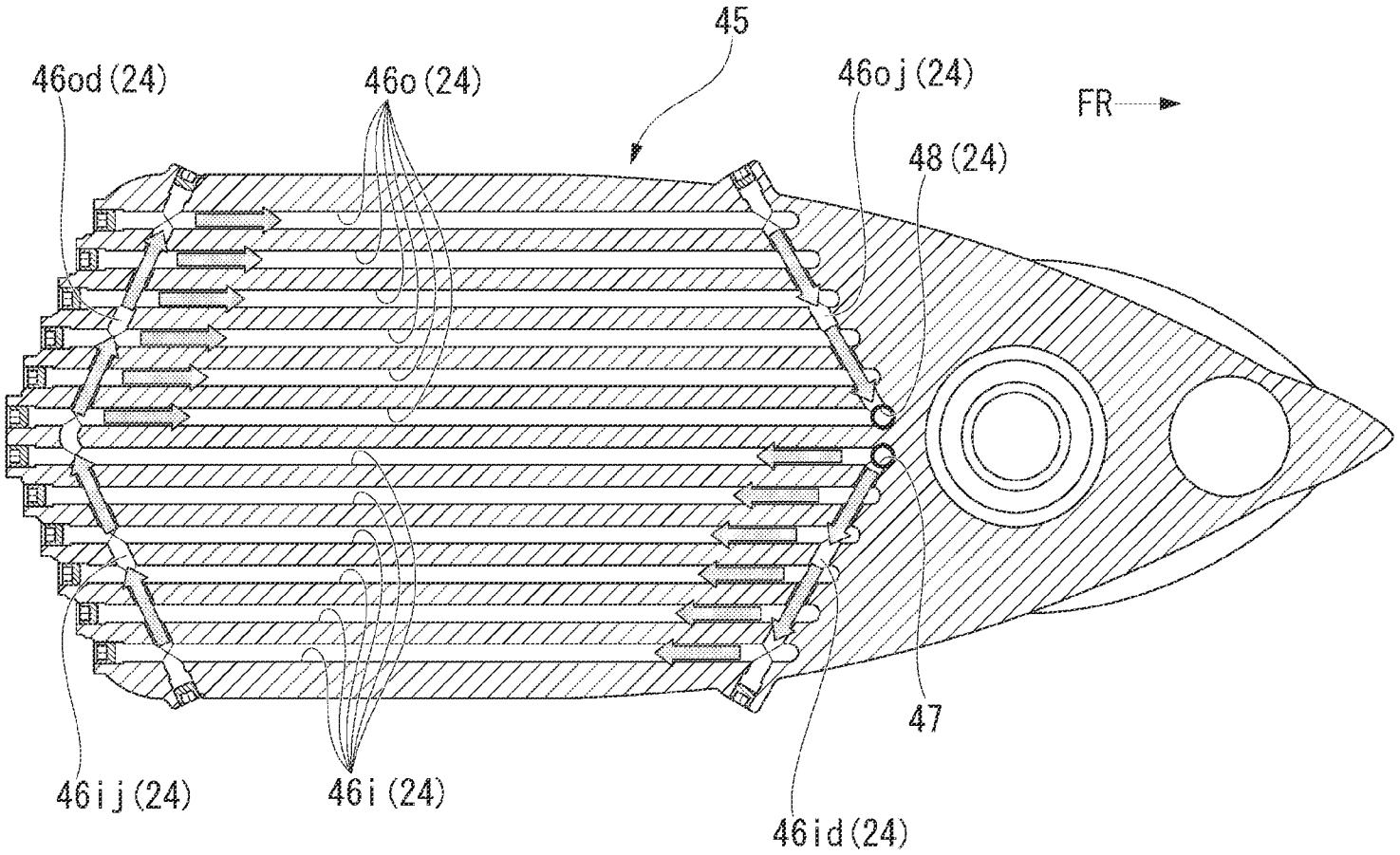
FIG. 3 is a cross-sectional view of an anti-cavitation plate that corresponds to a III-III cross-section of FIG. 1.
Figure 4:
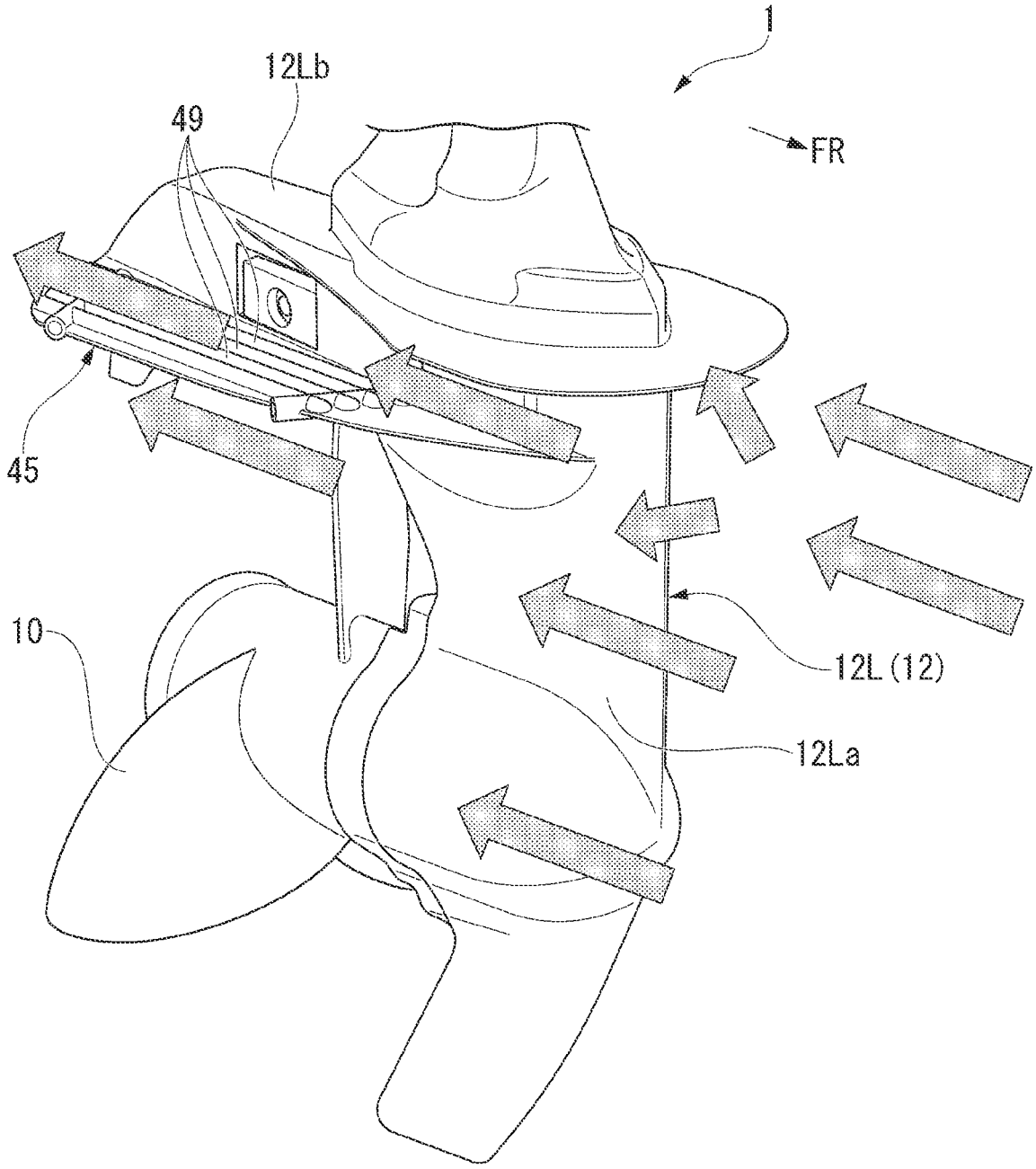
FIG. 4 is a perspective view of the electric outboard motor (propulsion apparatus) of the first embodiment.
Figure 5:
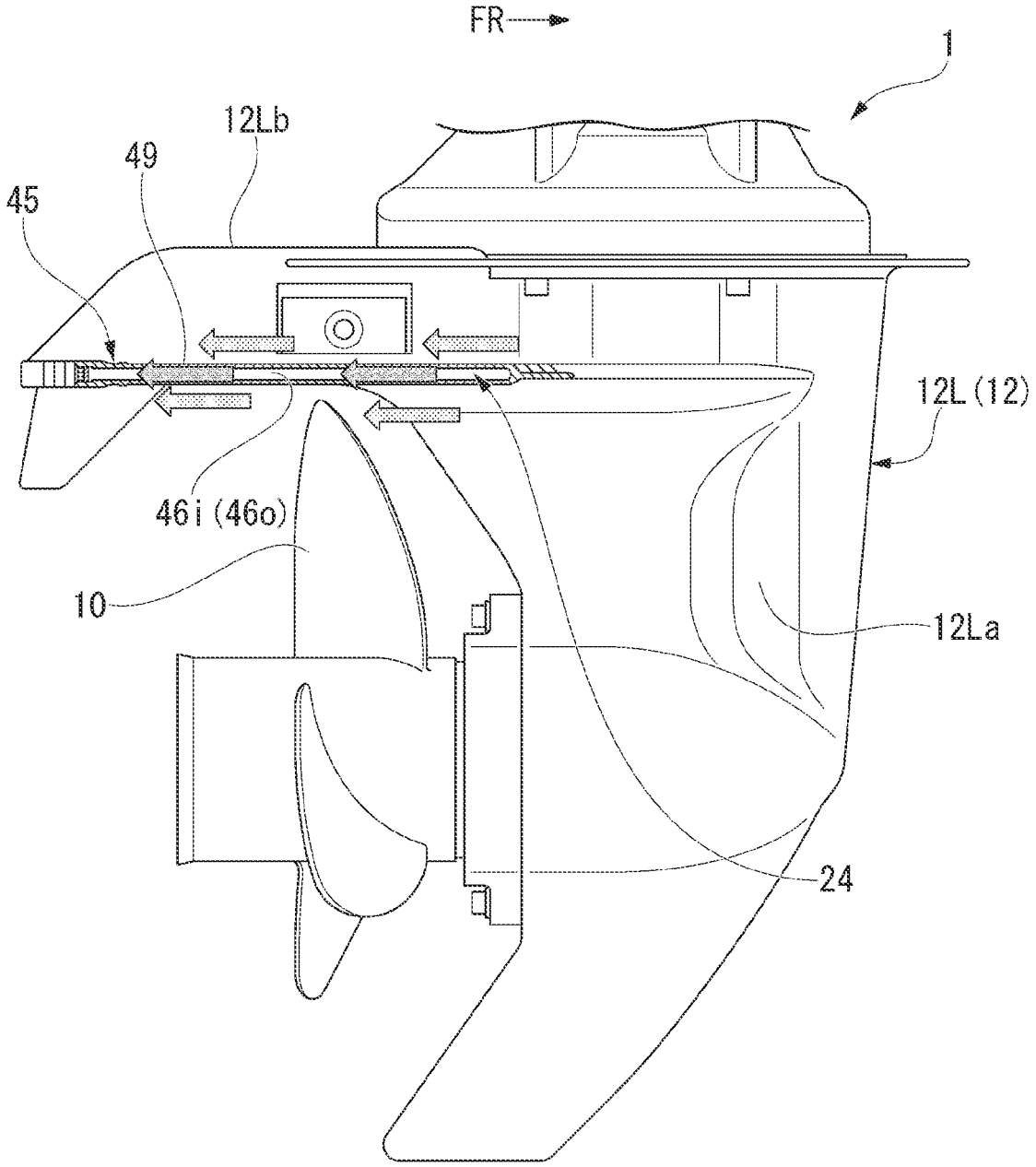
FIG. 5 is a partial cross-sectional side view of the electric outboard motor (propulsion apparatus) of the first embodiment.

FIG. 3 is a cross-sectional view of the anti-cavitation plate 45 that corresponds to a cross-section of FIG. 1. FIG. 4 is a perspective view of the electric outboard motor 1 when seen from a forward side, and FIG. 5 is a partial cross-sectional side of the electric outboard motor 1 in which part of the anti-cavitation plate 45 is a cross-section.

Part of the cooling liquid passage 24 described above is formed within the anti-cavitation plate 45. The cooling liquid passage 24 in the anti-cavitation plate 45 includes, as shown in FIG. 3, a plurality of inflow flow passages 46*i* (flow passage) that extends along a forward-rearward direction (propulsion direction) and a plurality of outflow flow passages 46*o* (flow passage) that similarly extends along the forward-rearward direction (propulsion direction). The plurality of inflow flow passages 46*i* are arranged in parallel at one side in a width direction of the anti-cavitation plate 45. The plurality of outflow flow passages 46*o* are arranged in parallel on another side in the width direction of the anti-cavitation plate 45. Accordingly, the plurality of inflow flow passages 46*i* and the plurality of outflow flow passages 46*o* along the propulsion direction are provided in the extension direction of the anti-cavitation plate 45. The cooling liquid flows along the propulsion direction in the inflow flow passage 46*i* and the outflow flow passage 46*o*.

Further, the cooling liquid passage 24 in the anti-cavitation plate 45 includes: an introduction hole 47 in which the cooling liquid that is supplied from the motor case portion 12U side is introduced; an inflow-side distribution flow passage 46*id* in which the cooling liquid which is introduced into the introduction hole 47 is distributed to first end sides of the plurality of inflow flow passages 46*i*; and an inflow-side convergence flow passage 46*ij* that causes the cooling liquids which have arrived at second end sides of the plurality of inflow flow passages 46*i* to converge. The cooling liquid passage 24 in the anti-cavitation plate 45 further includes: an outflow-side distribution flow passage 46*od* in which the cooling liquid that has flowed in from the inflow-side convergence flow passage 46*ij* is distributed to first end sides of the plurality of outflow flow passages 46*o*; an outflow-side convergence flow passage 46*oj* that causes the cooling liquids which have arrived at second end sides of the plurality of outflow flow passages 46*o* to converge; and a return hole 48 that causes the cooling liquid of the outflow-side convergence flow passage 46*oj* to return to the motor case portion 12U side.

The introduction hole 47 and the return hole 48 are formed on an upper surface at an inside in the width direction close to the case main body 12La. The introduction hole 47 and the return hole 48 are connected to an introduction passage and a return passage that are formed in the case main body 12La. The introduction passage and the return passage are connected to a flow passage (a flow passage connected to a discharge portion of the pump device 31 and a flow passage toward the heat generation portion 11*b*) on the motor case portion 12U side via an annular passage (not shown) formed on a fitting surface between the gear case portion 12L and the motor case portion 12U.

Further, an irregular portion 49 having a corrugated shape in a cross-section is formed on an outer surface on an upper surface side and an outer surface on a lower surface side of the anti-cavitation plate 45 along the plurality of inflow flow passages 46*i* and the plurality of outflow flow passages 46*o*. The irregular portion 49 extends along the propulsion direction. An outer circumferential wall of each of the inflow flow passage 46*i* and the outflow flow passage 46*o* has a substantially constant thickness. Further, in the present embodiment, outer circumferential walls of the inflow-side distribution flow passage 46*id*, the inflow-side convergence flow passage 46*ij*, the outflow-side distribution flow passage 46*od*, and the outflow-side convergence flow passage 46*oj* also have a substantially constant thickness.

Here, at the time of operation of the marine vessel, a water flow of outside water w indicated by an arrow in FIG. 4 and FIG. 5 is generated in the vicinity of the gear case portion 12L that is submerged in the outside water w. The water flow hits a front surface of the case main body 12La of the gear case portion 12L, then branches into right and left sides, and flows rearward along the outer surfaces on the upper and lower surface sides in right and left regions of the anti-cavitation plate 45. At this time, the cooling liquid that flows through the flow passage (46*id*, 46*i*, 46*ij*, 46*od*, 46*o*, 46*oj*) in the anti-cavitation plate 45 is cooled by the water flow of the outside water w through front and rear walls of the anti-cavitation plate 45. The flow of water that flows along the outer surfaces on the upper and lower surface sides of the anti-cavitation plate 45 becomes fast in accordance with the increase of the vessel speed. Therefore, when the thrust of the screw 10 is increased by the increase of the output of the electric motor 11, the cooling performance of the cooling liquid in the flow passage (46*id*, 46*i*, 46*ij*, 46*od*, 46*o*, 46*oj*) is enhanced in response to the increase of the thrust.

As described above, in the electric outboard motor 1 (propulsion apparatus) of the present embodiment, part (flow passage 46*id*, 46*i*, 46*ij*, 46*od*, 46*o*, 46*oj*) of the cooling liquid passage 24 is arranged within the anti-cavitation plate 45. Therefore, the cooling liquid can be efficiently cooled by the fast water flow of the outside water w that flows at upper and lower sides of the anti-cavitation plate 45 at the time of navigation of the marine vessel. Accordingly, when the electric outboard motor 1 of the present embodiment is employed, the cooling liquid that flows to the heat generation portion 11*b* can be efficiently cooled by the outside water w.

Further, in the electric outboard motor 1 (propulsion apparatus) of the present embodiment, part of the cooling liquid passage 24 that is arranged within the anti-cavitation plate 45 includes the inflow flow passage 46*i* and the outflow flow passage 46*o* through which the cooling liquid flows along the propulsion direction. Therefore, the cooling liquid can be further efficiently cooled by the water flow of the outside water w that flows at upper and lower sides of the anti-cavitation plate 45 while the cooling liquid flows through the inflow flow passage 46*i* and the outflow flow passage 46*o* in the anti-cavitation plate 45.

Further, in the electric outboard motor 1 (propulsion apparatus) of the present embodiment, the plurality of inflow flow passages 46*i* and the plurality of outflow flow passages 46*o* are provided in the extension direction of the anti-cavitation plate 45, and the irregular portion 49 along each of the flow passages is provided on the outer surface of the anti-cavitation plate 45. Therefore, the outer surface of the anti-cavitation plate comes into contact with the water flow of the outside water w over a large surface area. Accordingly, when the present configuration is employed, the cooling liquid that flows through the cooling liquid passage 24 in the anti-cavitation plate 45 can be efficiently cooled while preventing an operation resistance at the outer surface of the anti-cavitation plate 45.

Second Embodiment

Figure 6:
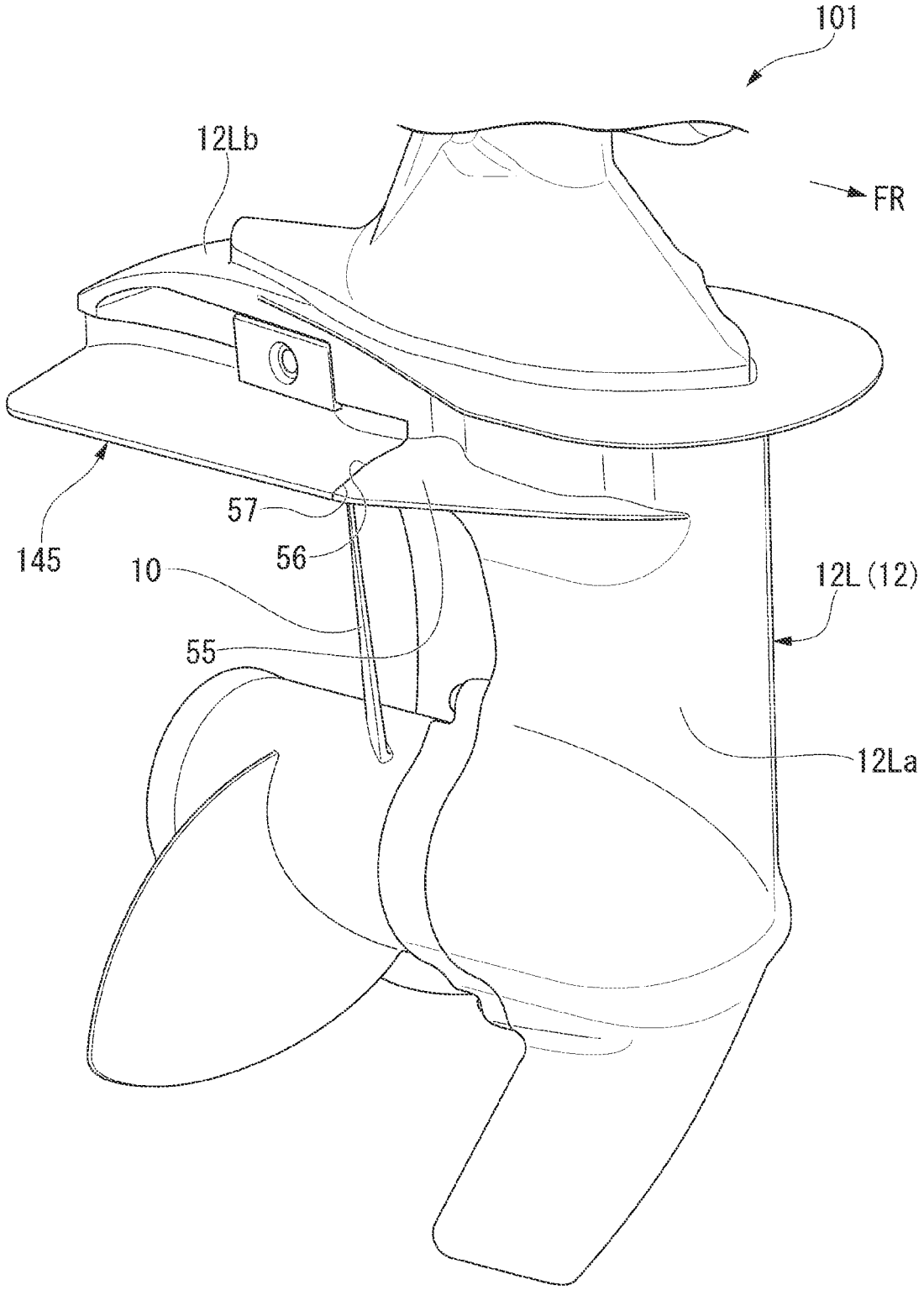
FIG. 6 is a perspective view of an electric outboard motor (propulsion apparatus) of a second embodiment.
Figure 7:
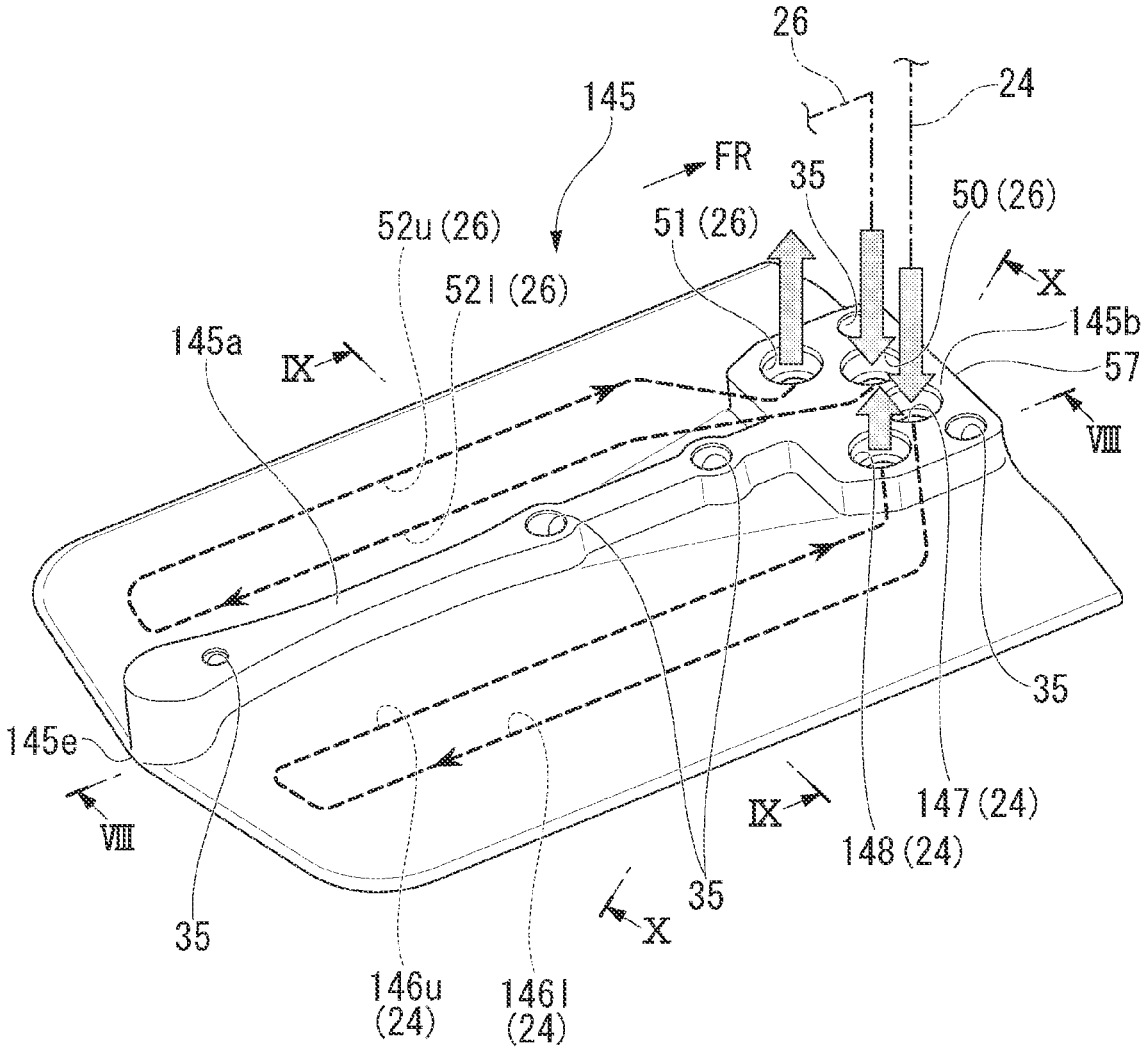
FIG. 7 is a perspective view of an anti-cavitation plate of the second embodiment.
Figure 8:
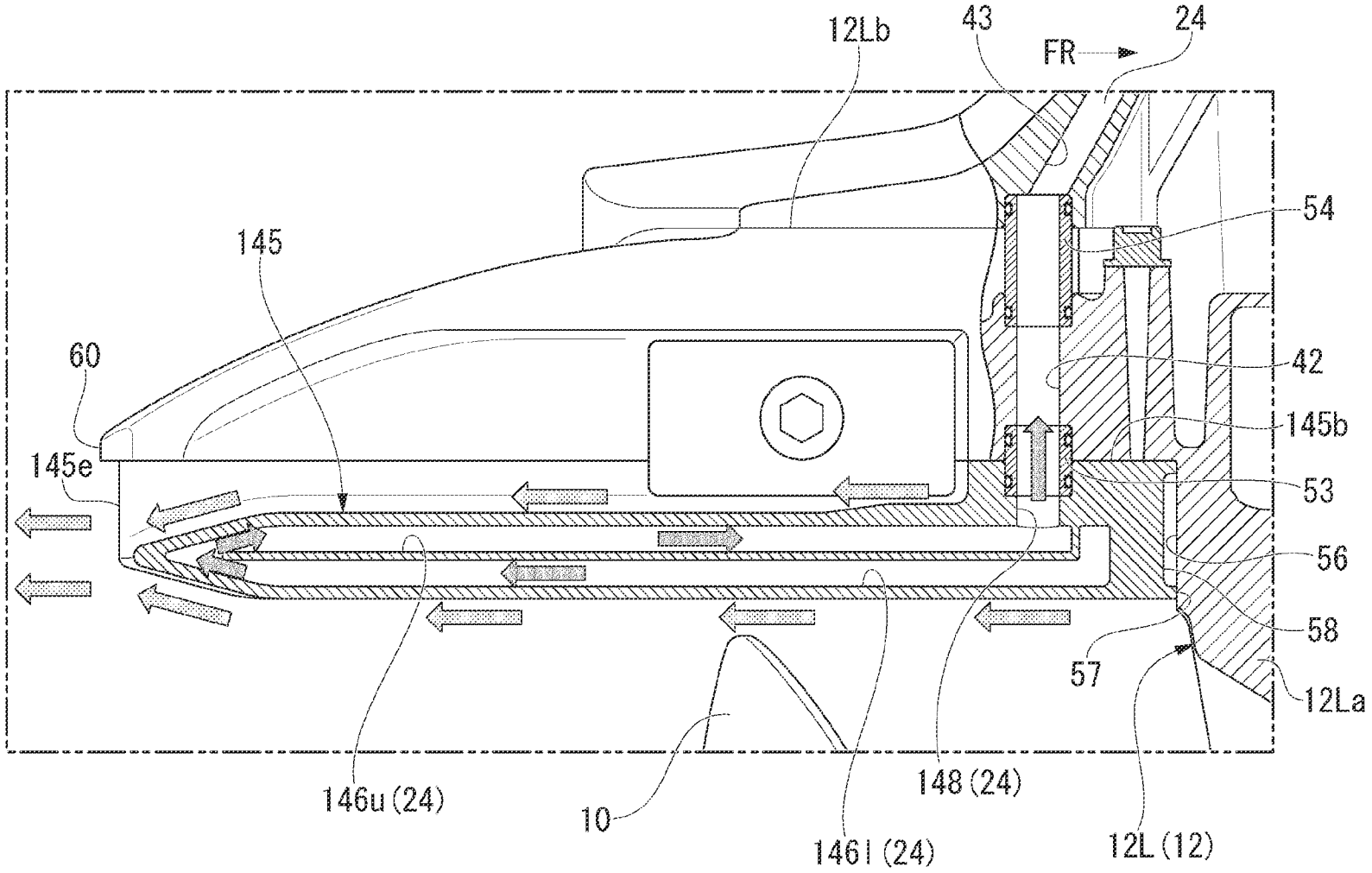
FIG. 8 is a cross-sectional view corresponding to a cross-section along a VIII-VIII line of FIG. 7 of the electric outboard motor (propulsion apparatus) of the second embodiment.
Figure 9:
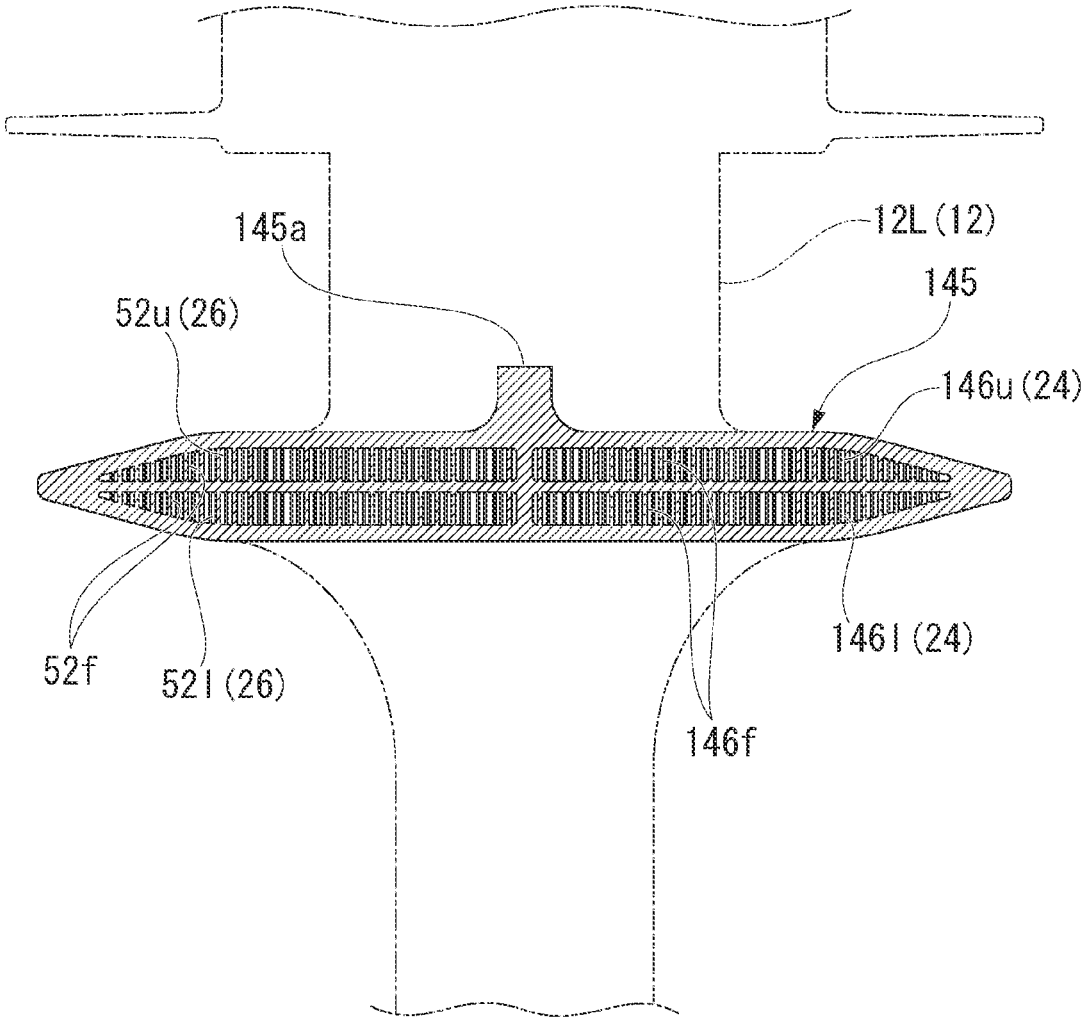
FIG. 9 is a cross-sectional view along a IX-IX line of FIG. 7.
Figure 10:
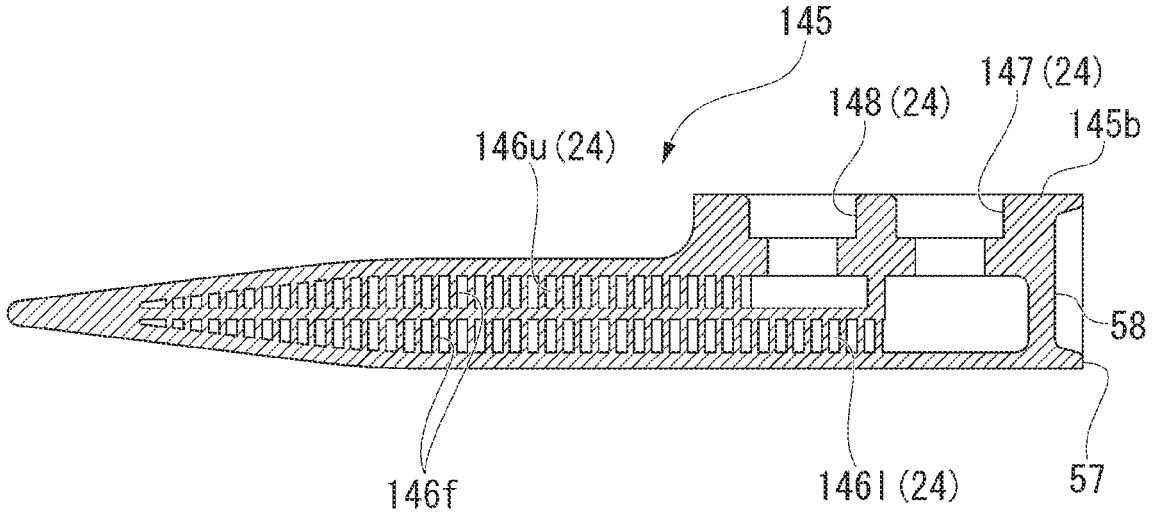
FIG. 10 is a cross-sectional view along a X-X line of FIG. 7.

FIG. 6 is a perspective view of an electric outboard motor 101 of the present embodiment when seen from a forward side, and FIG. 7 is a perspective view of an anti-cavitation plate 145 of the present embodiment when seen from an upward side. FIG. 8 is a cross-sectional view corresponding to a cross-section along a VIII-VIII line of FIG. 7 of the electric outboard motor 101. FIG. 9 is a cross-sectional view along a IX-IX line of FIG. 7, and FIG. 10 is a cross-sectional view along a X-X line of FIG. 7.

Similarly to the first embodiment, the electric outboard motor 101 includes: a screw 10; an electric motor (not shown) which is a drive source that drives the screw 10; and an outboard motor case 12 (unit case) that accommodates a drive-related component therein. The outboard motor case 12 accommodates a power transmission mechanism (not shown) that transmits power from the electric motor to the screw 10 in addition to the electric motor.

Similarly to the first embodiment, the outboard motor case 12 includes a motor case portion (not shown) that accommodates the electric motor and a gear case portion 12L that accommodates the power transmission mechanism. The gear case portion 12L is rotatably connected to a lower section of the motor case portion 12U. The screw 10 is arranged at a lower rear side of a rear wall of the gear case portion 12L.

Further, a cooling liquid storage portion (not shown) that stores a cooling liquid and a pump device (not shown) for suctioning the cooling liquid in the cooling liquid storage portion and causing the cooling liquid to flow to the cooling liquid passage 24 (refer to FIG. 7 and FIG. 8) are arranged within the motor case portion. A cooling liquid that contains a lubrication oil component is used for the cooling liquid stored in the cooling liquid storage portion. The cooling liquid passage 24 sends the cooling liquid suctioned from the cooling liquid storage portion by the pump device to the gear case portion 12L side, and the cooling liquid is cooled by heat exchange with the outside water w at the gear case portion 12L side. Then, the cooling liquid passage 24 causes the cooling liquid that is cooled at the gear case portion 12L side to return to the motor case portion side again, and the cooling liquid is discharged to a heat generation portion of the electric motor.

Further, a cooling liquid passage 26 (refer to FIG. 7) of a separate line for causing the cooling liquid to flow to a control unit (for example, refer to the control unit of FIG. 1) which is a heat generation portion different from the electric motor is formed on the outboard motor case 12. Another cooling liquid such as a coolant that is different from the cooling liquid which flows through the cooling liquid passage 24 described above flows through the cooling liquid passage 26. The cooling liquid passage 26 constitutes a circulation flow passage through which the cooling liquid flows. A reserve tank (not shown), a pump device (not shown) for supplying the cooling liquid, and a heat exchanger (not shown) that performs heat exchange with the control unit (heat generation portion) are provided in a middle portion of the circulation flow passage. The cooling liquid that flows through the cooling liquid passage 26 cools the control unit (heat generation portion) in the heat exchanger. Further, the cooling liquid that has performed the heat exchange in the heat exchanger is supplied to the gear case portion 12L side and is cooled by heat exchange with the outside water. The cooling water cooled at the gear case portion 12L side is supplied to the heat exchanger of the control unit (heat generation portion) again.

The gear case portion 12L includes: a case main body 12La that accommodates the power transmission mechanism therein and has a hollow shape; and a rearward extension portion 12Lb that extends rearward in a propulsion direction from the case main body 12La. An anti-cavitation plate 145 that is separate from the gear case portion 12L is attached to a lower surface of the rearward extension portion 12Lb. The anti-cavitation plate 145 is arranged so as to cover an upper side of the screw 10. At least a lower side of the anti-cavitation plate 145 is submerged in the outside water at the time of navigation of the marine vessel, and the anti-cavitation plate 145 prevents air entrainment (occurrence of cavitation) by the screw 10.

As shown in FIG. 7, the anti-cavitation plate 145 is formed in a substantially rectangular shape in plan view that is elongated in the propulsion direction (forward-rearward direction). The anti-cavitation plate 145 is formed of, for example, an aluminum alloy or the like having good thermal conductivity. A middle projection portion 145*a* that has a band shape and projects upward at a substantially middle position in the width direction, and a forward-side projection portion 145*b* that has a substantially rectangular shape in plan view and continues to a front end section of the middle projection portion 145*a* are formed on an upper surface of the anti-cavitation plate 145. Upper surfaces of the middle projection portion 145*a* and the forward-side projection portion 145*b* are overlapped on a lower surface of the rearward extension portion 12Lb of the gear case portion 12L and are fixed to the rearward extension portion 12Lb by bolting or the like. The entire region having a flat plate shape of the anti-cavitation plate 145 is substantially in a horizontal attitude in a state of being fixed to the rearward extension portion 12Lb.

A reference numeral 35 in FIG. 7 indicates a bolt insertion hole formed in the middle projection portion 145*a* and the forward-side projection portion 145*b*. A shaft portion of a bolt (not shown) for fixing the anti-cavitation plate 145 to the lower surface of the rearward extension portion 12Lb is inserted through the bolt insertion hole 35.

Part of the motor-side cooling liquid passage 24 and part of the control-unit-side cooling liquid passage 26 are formed at the inside of the anti-cavitation plate 145. Part of the motor-side cooling liquid passage 24 is formed in one region (for example, a region on the right side toward the forward direction of the propulsion direction) among regions that sandwich a middle portion in the width direction of the anti-cavitation plate 145. The control-unit-side cooling liquid passage 26 is formed in another region (for example, a region on the left side toward the forward direction of the propulsion direction) among the regions that sandwich the middle portion in the width direction of the anti-cavitation plate 145.

The motor-side cooling liquid passage 24 formed in the anti-cavitation plate 145 includes: an introduction hole 147 and a return hole 148 that are formed on an upper surface of the forward-side projection portion 145*b*; a lower flow passage 146*l* (flow passage) in which one end side is in communication with the introduction hole 147; and an upper flow passage 146*u* (flow passage) which is arranged on an upper portion of the lower flow passage 146*l* and in which one end side is in communication with the return hole 148. The lower flow passage 146*l* and the upper flow passage 146*u* extend along the propulsion direction in the anti-cavitation plate 145 and are in communication with each other in the vicinity of a rear end portion of the anti-cavitation plate 145.

As shown in FIG. 9, a plurality of fins 146*f* that serve as a rectification wall are provided to protrude on the lower flow passage 146*l* and the upper flow passage 146*u*.

A cooling liquid for cooling the motor that is supplied from the motor case portion side is introduced into the introduction hole 147. As shown in FIG. 7 and FIG. 8, the cooling liquid that flows into the lower flow passage 146*l* from the introduction hole 147 flows rearward in the propulsion direction in the lower flow passage 146*l*, changes the direction at the rear end portion, and flows forward in the propulsion direction in the upper flow passage 146*u*. The cooling liquid that has arrived at a front end portion of the upper flow passage 146*u* returns to the motor case portion side through the return hole 148.

Further, the control-unit-side cooling liquid passage 26 formed in the anti-cavitation plate 145 includes: an introduction hole 50 and a return hole 51 that are formed on an upper surface of the forward-side projection portion 145*b*; a lower flow passage 52*l* (flow passage) in which one end side is in communication with the introduction hole 50; and an upper flow passage 52*u* (flow passage) which is arranged on an upper portion of the lower flow passage 52*l* and in which one end side is in communication with the return hole 51. The lower flow passage 52*l* and the upper flow passage 52*u* extend along the propulsion direction in the anti-cavitation plate 145 and are in communication with each other in the vicinity of the rear end portion of the anti-cavitation plate 145.

As shown in FIG. 9, a plurality of fins 52*f* that serve as a rectification wall are also provided to protrude on the lower flow passage 52*l* and the upper flow passage 52*u* of the control-unit-side cooling liquid passage 26.

A cooling liquid for cooling the control unit that is supplied from the motor case portion side is introduced into the introduction hole 50. As shown in FIG. 7, the cooling liquid that flows into the lower flow passage 52*l* from the introduction hole 50 flows rearward in the propulsion direction in the lower flow passage 52*l*, changes the direction at the rear end portion, and flows forward in the propulsion direction in the upper flow passage 52*u*. The cooling liquid that has arrived at a front end portion of the upper flow passage 52*u* returns to the motor case portion side through the return hole 51.

A reference numeral 53 in FIG. 8 indicates a delivery pipe that connects the return hole 148 of the anti-cavitation plate 145 and a return passage 42 in the rearward extension portion 12Lb. A reference numeral 54 in FIG. 8 indicates a delivery pipe that connects the return passage 42 in the rearward extension portion 12Lb and a return passage 43 on the case main body 12La side. Another return hole 51 and the introduction hole 50, 147 of the anti-cavitation plate 145 can be similarly connected to the passage of the rearward extension portion 12Lb or the case main body 12La.

However, the introduction hole 50, 147 and the return hole 51, 148 of the anti-cavitation plate 145 may be connected by a delivery pipe to the passage of a member on the upper side in an inner space of the gear case portion 12L without passing through the rearward extension portion 12Lb.

Further, at a position of the same height as the anti-cavitation plate 145 on an outer circumferential surface of the case main body 12La, a plate extension portion 55 having a flange shape is formed so as to continue forward from front sections of right and left side edge portions of the anti-cavitation plate 145. Further, as shown in FIG. 8, a rear surface of the plate extension portion 55 and a rear surface of the case main body 12La at a position at the same height as the plate extension portion 55 are defined as a flat surface 56 that stands in a substantially vertical direction. On the other hand, a flat confronting surface 57 that abuts the flat surface 56 on the case main body 12La side is formed on a front end portion of the anti-cavitation plate 145.

The upper surface and the lower surface of the plate extension portion 55 are formed so as to be flush with the upper surface and the lower surface of the anti-cavitation plate 145, respectively, without a step in a state where the anti-cavitation plate 145 is fixed to the rearward extension portion 12Lb.

The anti-cavitation plate 145 is formed in a shape (a shape that gradually becomes thinner) in which a rear side smoothly converges toward a rear end portion as shown in FIG. 8. Further, as shown in FIG. 9, the anti-cavitation plate 145 is shaped such that both side portions in the width direction smoothly converge toward a side end portion. On the other hand, as shown in FIG. 8 and FIG. 10, a recess portion 58 that is hollowed in a direction away from the flat surface 56 on the case main body 12La side is formed on the confronting surface 57 at the front end portion of the anti-cavitation plate 145. The recess portion 58 is formed at least in a front region of the forward-side projection portion 145*b* of the front end portion of the anti-cavitation plate 145. Thereby, a heat insulation space is formed between the confronting surface 57 of the anti-cavitation plate 145 and the case main body 12La by the recess portion 58.

Further, as shown in FIG. 8 the rearward extension portion 12Lb that extends rearward from the case main body 12La of the outboard motor case 12 protrudes further rearward than a rear end portion 145*e* of the anti-cavitation plate 145. A rear end portion 60 of the rearward extension portion 12Lb is located at a further rearward position than the rear end portion 145*e* of the anti-cavitation plate 145.

As described above, in the electric outboard motor 101 (propulsion apparatus) of the present embodiment, part (flow passage 146*l*, 146*u*, 52*l*, 52*u*, and the like) of the cooling liquid passage 24, 26 is arranged within the anti-cavitation plate 145. Therefore, the cooling liquid can be efficiently cooled by the fast water flow of the outside water w that flows at upper and lower sides of the anti-cavitation plate 145 at the time of navigation of the marine vessel. Accordingly, also in a case where the electric outboard motor 101 of the present embodiment is employed, the cooling liquid that flows to the heat generation portion can be efficiently cooled by the outside water w.

Further, in the electric outboard motor 101 (propulsion apparatus) of the present embodiment, part of the cooling liquid passage 24, 26 that is arranged within the anti-cavitation plate 145 includes the flow passage 146*l*, 146*u*, 52*l*, 52*u* through which the cooling liquid flows along the propulsion direction. Therefore, the cooling liquid can be further efficiently cooled by the water flow of the outside water w that flows at upper and lower sides of the anti-cavitation plate 145 while the cooling liquid flows through the flow passage 146*l*, 146*u*, 52*l*, 52*u* in the anti-cavitation plate 145.

In particular, in the electric outboard motor 101 (propulsion apparatus) of the present embodiment, the upper flow passage 146*u*, 52*u* and the lower flow passage 146*l*, 52*l* are formed within the anti-cavitation plate 145. Therefore, the cooling liquid in the cooling liquid passage 24, 26 can be efficiently cooled by the outside water at the lower surface and the upper surface of the anti-cavitation plate 145 at the time of navigation of the marine vessel.

Further, in the electric outboard motor 101 (propulsion apparatus) of the present embodiment, the cooling liquid that has cooled the heat generation portion flows in the lower flow passage 146*l*, 52*l*, and the cooling liquid that has passed through the lower flow passage 146*l*, 52*l* flows to the upper flow passage 146*u*, 52*u*. Therefore, the cooling liquid which has absorbed the heat of the heat generation portion and has a large amount of heat is efficiently cooled at the lower surface of the anti-cavitation plate 145 that is reliably submerged in the outside water. Accordingly, when the present configuration is employed, stable cooling of the cooling liquid by the outside water becomes possible.

Further, in the electric outboard motor 101 (propulsion apparatus) of the present embodiment, the rearward extension portion 12Lb of the gear case portion 12L protrudes further rearward in the propulsion direction than the rear end portion 145*e* of the anti-cavitation plate 145. Therefore, even if the rear portion of the electric outboard motor 101 comes into contact with a pier or the like, the rear end portion 60 of the rearward extension portion 12Lb comes into contact with the pier or the like before the anti-cavitation plate 145. Therefore, when the present configuration is employed, it is possible to prevent the cooling liquid passage 24, 26 in the anti-cavitation plate 145 from being damaged.

Further, in the electric outboard motor 101 (propulsion apparatus) of the present embodiment, the anti-cavitation plate 145 is constituted of a separate component that is separate from the gear case portion 12L, and the plate extension portion 55 is formed on the gear case portion 12L so as to continue forward from the front portion in the propulsion direction of the anti-cavitation plate 145. Therefore, even when a complex cooling liquid passage 24, 26 is formed within the anti-cavitation plate 145, the anti-cavitation plate can be easily shaped by a process that is separate from that for the gear case portion 12L.

Further, in the electric outboard motor 101 (propulsion apparatus), the upper surface and the lower surface of the plate extension portion 55 on the gear case portion 12L side are flush with the upper surface and the lower surface of the anti-cavitation plate 145, respectively. Therefore, although the anti-cavitation plate 145 is a separate component that is separate from the gear case portion 12L, it is possible to reduce the resistance of the water flow at the time of navigation of the marine vessel, and it is possible to increase the flow speed of the outside water that flows at the upper surface side and the lower surface side of the anti-cavitation plate 145.

Only one of the upper surface and the lower surface of the plate extension portion 55 on the gear case portion 12L side may be flush with the corresponding upper surface or the corresponding lower surface on the anti-cavitation plate 145 side.

Further, in the case of the electric outboard motor 101 of the present embodiment, the plate extension portion 55 of the gear case portion 12L continues to the front portion of the anti-cavitation plate 145 and thereby functions so as to prevent cavitation from occurring together with the anti-cavitation plate 145. However, the cooling liquid passage 24, 26 is formed only on the anti-cavitation plate 145 and is not formed on the plate extension portion 55. Therefore, the heat of the cooling liquid in the cooling liquid passage 24, 26 that has absorbed the heat of the heat generation portion is not easily transmitted to the gear case portion 12L side.

Further, in the electric outboard motor 101 (propulsion apparatus) of the present embodiment, the recess portion 58 is provided on the confronting surface 57 with the gear case portion 12L at the front portion of the anti-cavitation plate 145. Therefore, when the confronting surface 57 of the front portion of the anti-cavitation plate 145 is abutted against the rear section of the gear case portion 12L, a heat insulation space by the recess portion 58 is formed between the gear case portion 12L and the front portion of the anti-cavitation plate 145. Accordingly, when the present configuration is employed, the heat of the cooling liquid that has absorbed the heat of the heat generation portion is not further easily transmitted from the front portion of the anti-cavitation plate 145 to a component such as a seal member on the gear case portion 12L side. Thereby, a component such as a seal member on the gear case portion 12L side can be protected from the heat of the cooling liquid.

A notch or a clearance (a clearance with the gear case portion 12L) may be set at an edge of the recess portion 58, and thereby, the outside water may easily flow into the recess portion 58.

Further, the electric outboard motor 101 (propulsion apparatus) of the present embodiment includes a plurality of lines of the cooling liquid passage 24, 26 in each of which a different cooling liquid flows, and part of each of the plurality of lines of the cooling liquid passage 24, 26 is formed within the anti-cavitation plate 145. Therefore, the different cooling liquids that flow in the plurality of lines of the cooling liquid passage 24, 26 can be efficiently cooled by using the common anti-cavitation plate 145.

In particular, in the present embodiment, since the anti-cavitation plate 145 is constituted of a separate component that is separate from the gear case portion 12L, even when the passage shape in the anti-cavitation plate 145 becomes complex, it is possible to easily shape the anti-cavitation plate 145.

Third Embodiment

Figure 11:
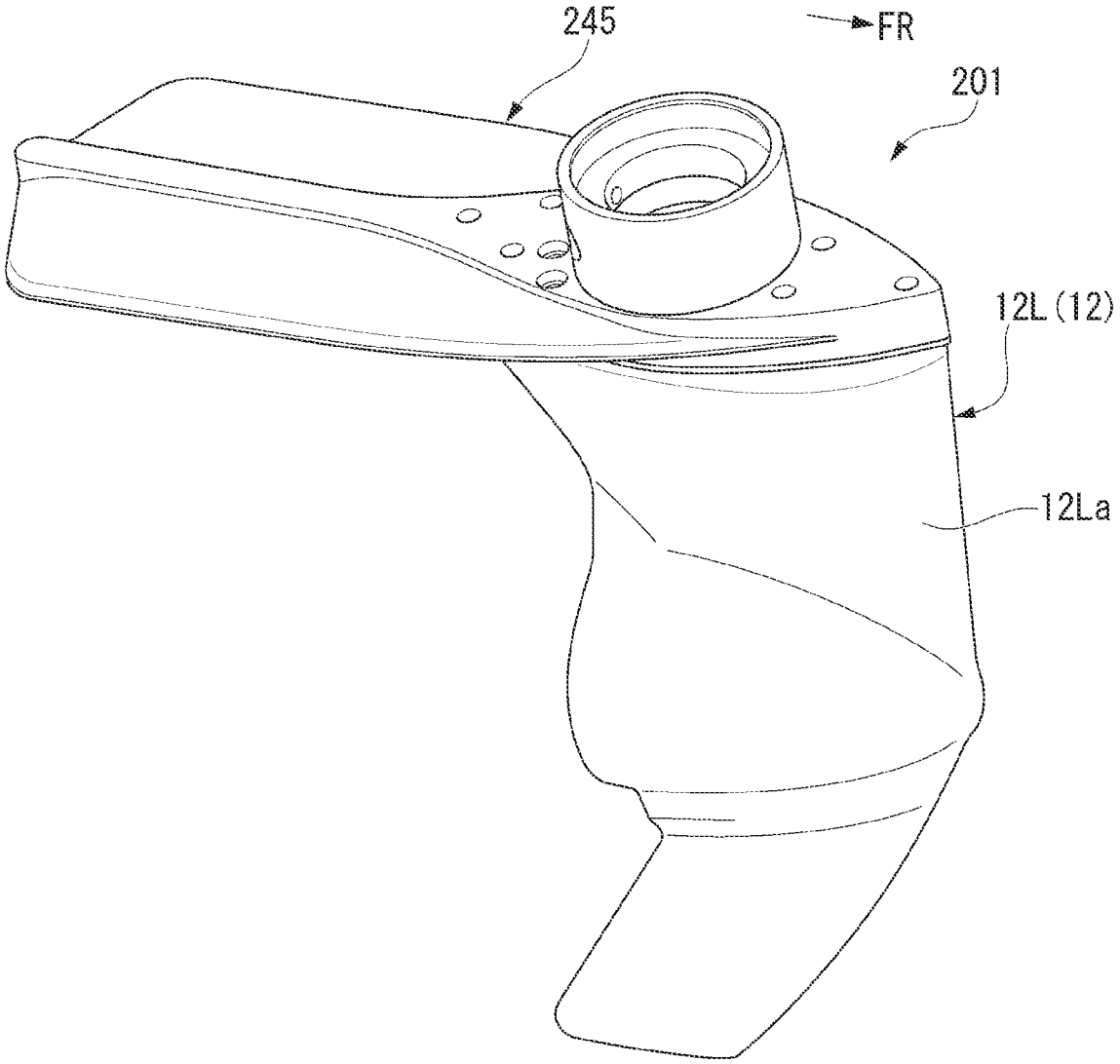
FIG. 11 is a perspective view of an electric outboard motor (propulsion apparatus) of a third embodiment.

FIG. 11 is a perspective view of an electric outboard motor 201 of the present embodiment when seen from a forward side.

In the electric outboard motor 201 of the present embodiment, similarly to the second embodiment described above, an anti-cavitation plate 245 is formed of a separate component that is separate from the case main body 12La of the gear case portion 12L. In the second embodiment, the anti-cavitation plate 145 is arranged relatively compactly at a further rearward side than the rear surface of the case main body 12La, but the anti-cavitation plate 245 of the present embodiment is formed so as to also cover an upper portion and a circumferential portion of the case main body 12La such that the entire capacity is large.

Since the basic configuration of the electric outboard motor 201 of the present embodiment is approximately similar to those of the embodiments described above, basic effects similar to those of the embodiments described above can be obtained.

However, since in the electric outboard motor 201 of the present embodiment, the anti-cavitation plate 245 has a shape having a large entire capacity so as to also cover the upper portion and the circumferential portion of the case main body 12La, the area of the cooling liquid passage formed within the anti-cavitation plate 245 can be further enlarged. Accordingly, when the present configuration is employed, the cooling performance of the cooling liquid at the anti-cavitation plate 245 can be further enhanced.

The present invention is not limited to the embodiments described above, and various design changes can be made without departing from the scope of the invention.

For example, the above embodiments are described using an electric outboard motor as an example of the propulsion apparatus; however, the propulsion apparatus is not limited to an electric outboard motor. The propulsion apparatus may be an outboard engine that is driven by an engine. In this case, a cylinder portion or the like of the engine which is the heat generation portion may be cooled by the cooling liquid.

Further, the propulsion apparatus is not limited to an outboard engine and may be an inboard-outdrive engine in which a drive source such as an engine or a motor is provided on a hull side.

DESCRIPTION OF REFERENCE NUMERALS

1, 101, 201 Electric outboard motor (propulsion apparatus)
10 Screw
11 Electric motor (drive source)
11*b* Heat generation portion
12 Outboard motor case (unit case)
12Lb Rearward extension portion
13 Power transmission mechanism
24 Cooling liquid passage
45, 145, 245 Anti-cavitation plate
46*i* Inflow flow passage (flow passage)
46*o* Outflow flow passage (flow passage)
52*l*, 146*l* Lower flow passage (flow passage)
52*u*, 146*u* Upper flow passage (flow passage)
55 Plate extension portion
57 Confronting surface
58 Recess portion
w Outside water

What is claimed is:

1. A marine vessel propulsion apparatus, comprising:
a screw that is submerged in outside water and generates a propulsion force;
a unit case that accommodates at least a power transmission mechanism which transmits power from a drive source to the screw;
an anti-cavitation plate that is arranged on the unit case at a higher position than the screw and is at least partially submerged in outside water;
a heat generation portion that is arranged at an inside or an outside of the unit case; and
a cooling liquid passage that causes a cooling liquid to flow to the heat generation portion,
wherein part of the cooling liquid passage is arranged within the anti-cavitation plate,
the part of the cooling liquid passage has a plurality of flow passages through which the cooling liquid flows,
the plurality of flow passages are arranged in parallel with each other, and
a plurality of irregular portions, each having a corrugated shaped cross-section along each of the flow passages, are formed on an outer surface of the anti-cavitation plate.

2. The marine vessel propulsion apparatus according to claim 1,
wherein one flow passage of the plurality of flow passages has an upper flow passage that flows to one side along a propulsion direction of a marine vessel and a lower flow passage that flows to an other side along the propulsion direction at an upstream of the upper flow passage.

3. The marine vessel propulsion apparatus according to claim 2,
wherein the cooling liquid that has cooled the heat generation portion flows in the lower flow passage, and the cooling liquid that has passed through the lower flow passage flows to the upper flow passage.

4. The marine vessel propulsion apparatus according to claim 1,
wherein a rearward extension portion that protrudes further rearward in a propulsion direction of a marine vessel than a rear end portion of the anti-cavitation plate is provided on the unit case.

5. The marine vessel propulsion apparatus according to claim 1,
wherein the anti-cavitation plate is constituted of a separate component that is separate from the unit case,
a plate extension portion is provided on the unit case so as to continue forward from a front end portion of the anti-cavitation plate in a propulsion direction of a marine vessel, and
at least one of an upper surface and a lower surface of the plate extension portion is flush with a corresponding upper surface or a corresponding lower surface of the anti-cavitation plate.

6. The marine vessel propulsion apparatus according to claim 5,
wherein a recess portion is provided on a confronting surface with the unit case at a front portion of the anti-cavitation plate.

7. The marine vessel propulsion apparatus according to claim 1,
wherein the cooling liquid passage has a plurality of lines in each of which a different cooling liquid flows, and
part of each of the plurality of lines of the cooling liquid passage is arranged within the anti-cavitation plate.

8. The marine vessel propulsion apparatus according to claim 1,
wherein the plurality of flow passages are provided along a propulsion direction of a marine vessel, and
the plurality of irregular portions are provided along the propulsion direction.

9. The marine vessel propulsion apparatus according to claim 1,
wherein the plurality of flow passages have
an inflow flow passage located on one side relative to a width-wise center of the anti-cavitation plate, and
an outflow flow passage located on an other side relative to the width-wise center of the anti-cavitation plate and downstream of the inflow flow passage in a direction of flow of the cooling liquid.

10. The marine vessel propulsion apparatus according to claim 9,
wherein the inflow flow passage is provided such that the cooling liquid flows toward a first side of a propulsion direction of a marine vessel, and
the outflow flow passage is provided such that the cooling liquid flows toward a second side, which is opposite to the first side in the propulsion direction.

11. The marine vessel propulsion apparatus according to claim 9,
wherein the inflow flow passage has a plurality of inflow flow passages arranged in parallel with each other, and
wherein the flow passages have
an inflow-side distribution flow passage located on one side of the plurality of inflow flow passages and distributing the cooling liquid, and
an inflow-side convergence flow passage located on an other side of the plurality of inflow flow passages and merging the cooling liquid.

12. The marine vessel propulsion apparatus according to claim 9,
wherein the outflow flow passage has a plurality of outflow flow passages arranged in parallel with each other, and
wherein the flow passages have
an outflow-side distribution flow passage located on one side of the plurality of outflow flow passages and distributing the cooling liquid, and
an outflow-side convergence flow passage located on an other side of the plurality of outflow flow passages and merging the cooling liquid.

13. The marine vessel propulsion apparatus according to claim 1, wherein the plurality of irregular portions are provided on both of the outer surface on an upper surface side and the outer surface on a lower surface side of the anti-cavitation plate.

14. The marine vessel propulsion apparatus according to claim 1, wherein outer circumferential walls of each of the plurality of flow passages are formed with a constant thickness.

15. The marine vessel propulsion apparatus according to claim 1, wherein the cooling liquid passage is integrally formed with the anti-cavitation plate.

* * * * *